United States Patent [19]

Schönmeier

[11] Patent Number: 4,483,493

[45] Date of Patent: Nov. 20, 1984

[54] CORE HOLDER FOR A WINDER

[75] Inventor: Herbert Schönmeier, Düsseldorf, Fed. Rep. of Germany

[73] Assignee: Jagenberg AG, Düsseldorf, Fed. Rep. of Germany

[21] Appl. No.: 365,762

[22] Filed: Apr. 5, 1982

[30] Foreign Application Priority Data

Nov. 14, 1981 [DE] Fed. Rep. of Germany ... 8133346[U]

[51] Int. Cl.[3] ..... B65H 17/02

[52] U.S. Cl. ..... 242/66; 242/68.4

[58] Field of Search ..... 242/57.1, 66, 68, 68.3, 242/68.4, 68.7, DIG. 3; 226/19, 20, 24

[56] References Cited

U.S. PATENT DOCUMENTS

| | | | |
|---|---|---|---|
| 2,672,198 | 3/1954 | Jones et al. | 242/57.1 X |
| 2,672,299 | 3/1954 | Jones | 245/57.1 X |
| 2,741,440 | 4/1956 | Sutherland | 242/57.1 X |
| 3,222,005 | 12/1965 | Wendelken | 242/57.1 |
| 3,232,547 | 2/1966 | Theide et al. | 242/57.1 |
| 4,366,932 | 1/1983 | Focke | 242/57.1 X |

*Primary Examiner*—Stuart S. Levy

*Assistant Examiner*—David Werner

*Attorney, Agent, or Firm*—Sprung, Horn, Kramer & Woods

[57] ABSTRACT

In a machine for the centerless winding of webs (2), including support cylinders (3), a holder (4) for a core on which the web is to be wound, a motor-driven spindle (11) for the axial displacement of the core holder rotatably mounted on a shaft (5) displaceable in a guide (8), (9), and means for limiting the axial length of travel of the core holder, the improvement wherein said travel limiting means includes a control shaft (15) coupled with the drive motor (12) through a step-down gearing (14), (16), a slip coupling (18), (19), (20), trippers (23), (24), for limit switches (25), (26), associated with the drive motor, and a cam (21) in whose path an abutment (22) is disposed, the step-down gearing (14), (16), having such a ratio that no more than one full rotation of the control shaft (15) corresponds to the predetermined length of travel. Thereby even after resetting the winder to a web of different width there will still be the same limits on the axial length of travel of the core holder when replacing cores.

1 Claim, 2 Drawing Figures

CORE HOLDER FOR A WINDER

BACKGROUND

Figure 1:
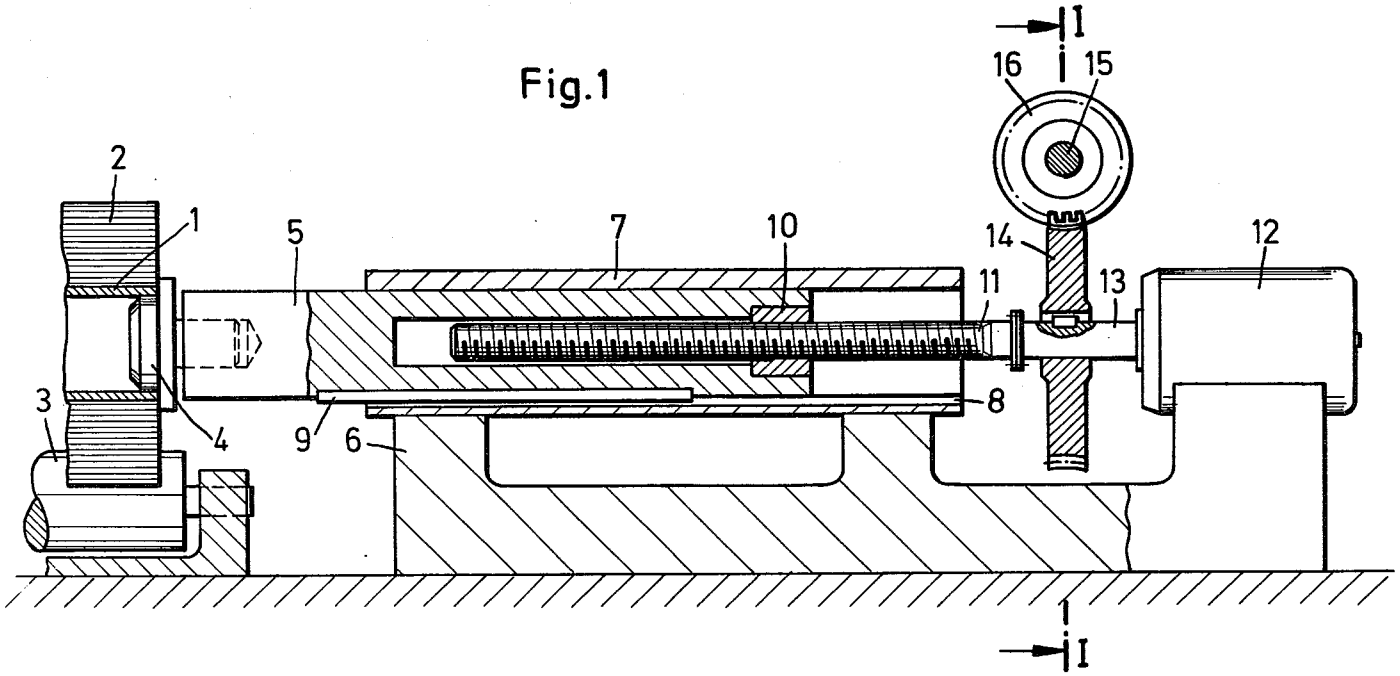

The invention relates to a core holder for a winder for the centerless winding of webs, having a motor-driven spindle for the axial displacement of the core holder which is rotatably mounted on a sliding shaft mounted in a quill, a travel limiting means being provided to limit the axial movement of the core holder.

In the centerless winding of webs in a winding machine in which the roll is cradled between two supporting cylinders, the roll is held axially by the core holders set into the opposite ends of the roll. To change rolls it is necessary that at least one of the core holders be able to be axially shifted over a distance of, for example, 50 mm. For this displacement, a motor-driven spindle is provided, which engages the sliding shaft of a core holder. Several means are known for limiting the length of axial travel. In a first known travel limiting means a counter is provided which receives counting pulses produced by the rotation of the spindle and operates the drive motor according to the counting pulses received. A second, purely mechanical travel limiting means consists of two abutments engaging the sliding shaft.

In the event that the winder has to be reset for a smaller size, i.e., for a shorter distance between the core holders, it is necessary to extend the core holder on the sliding shaft beyond the position set by the travel limiting means. To make this possible, the electrical control means in the case of the first travel limiting means is so constructed that the stop pulse given to the motor by the counter when the one position is reached can be inactivated. The numerical value set at the counter for limiting the movement is preserved, however, so that, when the new core holder position is reached, the control means can act with the counter as a travel limiting means the same as it did at the former position. The changeover to another size in the case of the second, purely mechanical travel limiting means is, however, substantially more complicated. In this case it is necessary to loosen from the sliding shaft a pawl which cooperates with the abutments, so that it can be displaced axially on the sliding shaft. Not until the core holder has reached its new position can the pawl be locked axially again on the sliding shaft.

THE INVENTION

It is the object of the invention to create a core holder for a winder for the centerless winding of webs, whereby repositioning for a smaller size will be possible without complicated adjustments.

This object is achieved in accordance with the invention in that a control shaft for the travel limitation is coupled with the motor through a reduction gearing and a slip coupling, the control shaft bearing trippers for the limit switches associated with the motor and bearing a cam in whose path an abutment is disposed, and in that the reduction gearing has such a ratio that no more than one full rotation of the control shaft corresponds to the predetermined travel.

In the invention, the motor for the displacement of the core holder serves not just for gripping and releasing the roll, but also for repositioning. Upon a changeover to a smaller size, the stop signal given to the motor by the limit switch when the associated position of the core holder is reached is rendered inactive in a simple manner, for example by by-passing the limit switches or interrupting the signal conductor, depending on what type of control is used. The length of travel previously set is retained. Furthermore, the trippers are moved to the one end position simultaneously with the repositioning, so that any further adjusting work is unnecessary.

Figure 2:
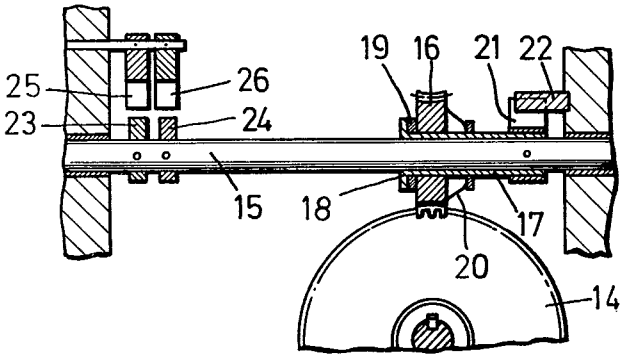

The invention will be explained hereinafter with reference to the drawing which presents a diagrammatic representation of an embodiment thereof, wherein FIG. 1 is an axial cross section through a core holder in a winder with corresponding adjusting means, and FIG. 2 is an axial cross section on line I—I of FIG. 1 through a portion of the adjusting means.

A roll of material 2 wound on a core 1 is cradled between a driven pair of cylinders 3. To hold the roll 2 in place axially, a core holder 4 is inserted into the core 1. The core holder 4 is rotatably mounted in a shaft 5 which is mounted for axial displacement in a quill 7 carried by the machine frame 6. The shaft 5 is held against rotation within the quill 7 by a rectilinear guide means consisting of the slot 8 and the key 9. The shaft 5 is hollow at the end opposite the core holder and contains a nut 10 borne on a threaded spindle 11 extending into the hollow of the shaft. The spindle 11 is driven by a motor 12.

With the winder described up to this point, it is possible to shift the sliding shaft 5 axially back and forth by operating the motor in one or the other sense of rotation.

On the spindle 11, or in the present case on the motor shaft 13, there is mounted a worm 14 which drives a worm gear 16 mounted on a control shaft 15. The worm gear 16 is mounted on a sleeve 17 disposed for co-rotation with the control shaft 15, this sleeve having a flange 18 against which the worm gear 16 is urged by a spring 20. Between the confronting faces of the worm gear 16 and of the flange 18 there is provided a clutch facing 19. In this manner, the worm gear 16 is therefore connected with the control shaft 18 by a slip coupling. The sleeve 17 furthermore bears a cam 21 into whose path extends a fixed abutment 22. Lastly, two trippers 23 and 24 are mounted on the control shaft 15 for co-rotation therewith, and with them there are associated limit switches 25 and 26 controlling the motor. The trippers 23 and 24 and/or their associated limit switches 25 and 26 can be moved about for the adjustment of a particular length of axial movement. The trippers 23 and 24 and their associated limit switches can be in the form of elements operating without physical contact.

The worm drive 14–16 has such a ratio that no more than one full rotation of the control shaft 15 corresponds to the maximum sliding shaft displacement. In any case, the relationship between cam 21 and the contact 23 controlling the left end position and the limit switch 25 is made such that, in the event of a stop signal given by the limit switch 25, the cam 21 will just come in contact with the abutment 22. With this relationship, it is then possible, once the core holder 4 has been driven to the new position, for the core holder to be shifted back and forth within the preset distance without further adjustments.

It will be understood that the specification and examples are illustrative but not limitative of the present invention and that other embodiments within the spirit and scope of the invention will suggest themselves to those skilled in the art.

What is claimed is:

1. In a machine for the centerless winding of webs on a core, including support cylinders for a web, a core holder, a motor driven spindle and means connected to the spindle for axially displacing the core holder within a given limited range of movement into and out of engagement with the core, the improvement wherein the means comprises means for adjusting the initial position of the core holder for the given limited range of movement to accommodate different length cores, the adjusting means comprising a threaded member threadably engaged with the spindle and connected to the core holder, a control shaft, means coupling the control shaft to the spindle including a step-down gearing having such a ratio that no more than one full rotation of the control shaft corresponds to the given limited range of movement and a slip-coupling for connecting a portion of the gearing to the control shaft, a limit switch including trippers connected to the control shaft for controlling the motor-driven spindle, a cam connected to the control shaft and a stationary abutment disposed in the path of the cam to effect a slipping of the gearing with respect to the control shaft when spindle rotation corresponds to more than one full rotation of the control shaft; whereby the continued rotation of the spindle while the gearing slips moves the spindle axially to a new initial position wherein the relationship between the limit switch, cam and stationary abutment is maintained to obtain the given limited range of movement without further adjustments.

* * * * *

UNITED STATES PATENT AND TRADEMARK OFFICE

CERTIFICATE OF CORRECTION

PATENT NO. : 4,483,493

DATED : November 20, 1984

INVENTOR(S) : Herbert Schömeier

It is certified that error appears in the above-identified patent and that said Letters Patent is hereby corrected as shown below:

| | |
|---|---|
| 1st page, under "Foreign Application Priority Data" | After "8133346" delete "[U]" |
| 1st page, under "U.S. Patent Documents" | Fifth line, correct spelling of "Thiede" |

Signed and Sealed this

*Twenty-third* Day of *April 1985*

[SEAL]

*Attest:*

DONALD J. QUIGG

*Attesting Officer*

*Acting Commissioner of Patents and Trademarks*